US005994018A

United States Patent [19]

Iida et al.

[11] Patent Number: 5,994,018

[45] Date of Patent: Nov. 30, 1999

[54] TONER

[76] Inventors: Wakashi Iida; Masaaki Taya; Makoto Kanbayashi; Tetsuya Ida; Junko Inaba, all c/o Canon Kabushiki Kaisha 3-30-2, Shimomaruko, Ohta-ku, Tokyo, Japan

[21] Appl. No.: 09/299,633

[22] Filed: Apr. 27, 1999

[30] Foreign Application Priority Data

Apr. 30, 1998 [JP] Japan ..... 10-120321
Mar. 9, 1999 [JP] Japan ..... 11-061527

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,626,487 | 12/1986 | Mitsuhashi et al. | 430/110 |
| 4,960,665 | 10/1990 | Elder et al. | 430/110 |
| 5,212,037 | 5/1993 | Julien et al. | 430/110 |
| 5,759,731 | 6/1998 | Hagi et al. | 430/111 |
| 5,814,428 | 9/1998 | Kido et al. | 430/111 |

*Primary Examiner*—Roland Martin
*Attorney, Agent, or Firm*—Fitzpatrick, Cella, Harper & Scinto

[57] ABSTRACT

A toner contains toner particles and fine alumina particles. The toner particles include a binding resin and a colorant. The fine alumina particles contain 200 to 700 $\mu$g of zirconium compound per gram of alumina. The toner may be used as a one-component developer or as a two-component developer with a carrier.

10 Claims, 1 Drawing Sheet

FIGURE
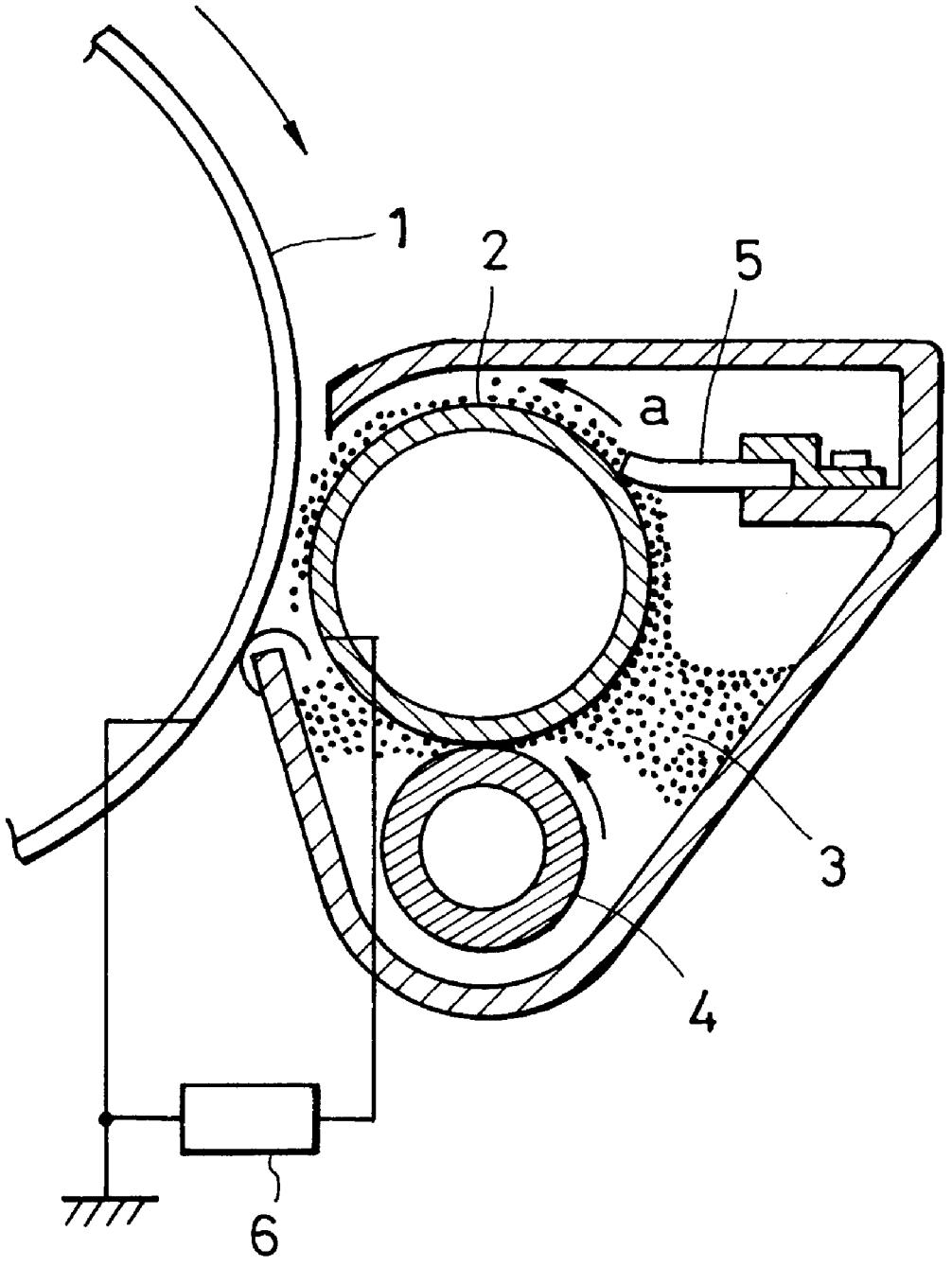

TONER

BACKGROUND OF THE INVENTION

1. Field of the Invention

The present invention relates to toners for developing electrostatic images in electrophotography, electrostatic recording and electrostatic printing, and for forming images in toner jet systems.

2. Description of the Related Art

Development of images formed on photoconductive materials by electrostatic means with toners is well known, as disclosed in, for example, U.S. Pat. No. 2,297,691 and Japanese Patent Publication Nos. 42-23910 and 43-24748. In such development, an electrostatic latent image is formed on a photosensitive member by various means, and a finely pulverized material responsive to electrical charge, called a "toner" is deposited onto the latent image to form a toner image corresponding to the electrostatic latent image.

The toner is transferred onto a surface of an image-holding member such as paper, if necessary, and then is fixed by heat, pressure, or vapor of a solvent to produce a copy. When the toner image is transferred, the process is generally provided with a step for removing the residual toner.

Disclosed methods for visualizing electrostatic latent images using toners include a powder cloud method disclosed in U.S. Pat. No. 2,221,776, a cascade developing method disclosed in U.S. Pat. No. 2,618,552, a magnetic brush method disclosed in U.S. Pat. No. 2,874,063, and a method using an electronically conductive, magnetically attractable toner disclosed in U.S. Pat. No. 3,909,258.

A typical toner used in these developing methods is composed of a particulate resin containing a colorant, and is prepared by mixing a thermoplastic resin with the colorant and then pulverizing the mixture. Thermoplastic resins which are most commonly used are polystyrene resins. Examples of other usable thermoplastic resins include polyester resins, epoxy resins, acrylic resins, and urethane resins. A typical colorant is carbon black. In magnetic toners, iron oxide-based black magnetic powder is widely used. In a two-component developer system, a toner is generally used in admixture with carrier particles, such as glass beads, powdered iron, or powdered ferrite.

Recently, monochrome copying machines have rapidly been replaced by full-color copying machines, and two-tone and full-color copying machines have been used. Improvements in reproducibility of color and gradation are reported in, for example, Journal of Electrophotographic Society, Vol. 22, No. 1, (1983); and ibid. Vol. 25, No. 1, 52(1986).

These full-color electrophotographic images used in practice, however, are not comparable to the originals and do not always satisfy those who are familiar with beautifully processed color images, such as on television, in photographs, and in color prints.

Formation of a color image by a full-color electrophotographic method generally includes color reproduction using three primary colors including yellow, magenta, and cyan. In this method, a photoconductive layer is exposed to light from an original which passes through a color-decomposing filter, which color is complementary to the color of toner so that an electrostatic image is formed on the layer. Next, a toner is held on a recording medium by developing and transferring steps. These steps are repeated several times so that different toners overlap on the same recording medium while adjusting the registration, and then only one fixing step is performed to fix a full-color image.

In a two-component development system using a developer composed of a toner and a carrier, the toner in the developer is charged to a predetermined polarity and a predetermined amount of electricity by friction with the carrier so that an electrostatic attractive force develops an electrostatic image. Thus, a satisfactory visible image is obtained when the toner has sufficient triboelectric charging characteristics which are determined by the interaction with the carrier.

Much research has been performed regarding various materials for developers so as to achieve sufficient triboelectric charging characteristics. The scope of the research includes development of carrier core materials, carrier coating agents, optimization of the amount of the coating agent, development of charge controlling agents and flowability-imparting agents added to toners, and improvements in binders as base materials.

For example, charging auxiliaries, such as chargeable fine particles, are added to toners as developers for the purpose of stabilizing triboelectric characteristics. Examples of such charging auxiliaries include powdered resins having an opposite polarity to toners, as disclosed in Japanese Patent Publication No. 52-32256 and Japanese Patent Application Laid-Open No. 56-64352; and a fluorine-containing compound, as disclosed in Japanese Patent Application Laid-Open No. 61-160760. Development of various charging auxiliaries continues.

Various methods for adding the above-mentioned charging auxiliaries have also been proposed. A typical method is coating of a charging auxiliary onto the surface of the toner particle by an electrostatic force or van der Waals attraction between the toner particle and the charging auxiliary caused during stirring or mixing. In such a method, however, the surface of the toner particle is not satisfactorily coated with the additive, and free additive particles which do not adhere to the toner unavoidably occur and form agglomerates. The larger the specific resistance of the charging auxiliary or the finer the particle diameter, the more significant this tendency. As a result, the toner has insufficient and unstable charging characteristics and results in, images for example, with nonuniform image density and fog. Furthermore, the charging auxiliary content may change during a continuous copying operation so that the initial image quality is not maintained.

In another method, a charging auxiliary, a binding resin and a colorant are added during production of a toner. The charging auxiliary is, however, barely homogenized. Furthermore, only the charging auxiliary which is present in the vicinity of the toner particle surface contributes to charging, and thus the charging auxiliary which is present in the interior of the particle does not contribute to charging. Thus, it is difficult to control the amount of the charging auxiliary to be added and the amount of the charging auxiliary adhered onto the toner particle surface. The toner obtained by such a method has unstable triboelectric charging characteristics, and thus does not have satisfactory developing characteristics. Accordingly, mere use of the charging auxiliary does not result in a toner having satisfactory quality.

Stabilization of triboelectric charging characteristics by adding external additives has been proposed. For example, Japanese Patent Application Laid-Open Nos. 61-275862, and 61-275863 disclose use of hydrophobic particulate alumina. This particulate alumina is coated with an amino-modified silicone oil, which inevitably agglomerates during hydrophobic treatment. As a result, the toner does not have high flowability.

Hydrophobic particulate alumina is also disclosed in Japanese Patent Application Laid-Open Nos. 62-8164, 62-129860, 62-129866, 62-209538, 4-345168, and 4-345169. These patent applications, however, do not suggest that important factors for achieving uniform hydrophobic treatment include the reactivity of particulate alumina with a hydrophobic agent and the crystal structure of the particulate alumina. The particulate alumina is primarily used for stabilization of charging, because silica is also added in order to impart high flowability to the toner. Providing high flowability and abrasive ability by alumina itself are open to further improvement.

Furthermore, Japanese Patent Application Laid-Open No. 2-251970 discloses an external alumina lubricant, the surface of which is treated with a coupling agent. However, such treatment of conventional alumina does not sufficiently stabilize charging characteristics under high temperature, high-humidity environments, and does not impart satisfactory flowability to the toner.

For the purpose of providing sufficient flowability, stabilized charging, and particularly prevention of overcharging in low-temperature, low-humidity environments, Japanese Patent Application Laid-Open Nos. 4-280254, 4-280255, and 4-345169 disclose fine alumina particle having a hydrophobicity of 40% or more. Although such alumina is effective in stabilization of charging characteristics, it is still unsatisfactory in terms of flowability compared to fine particulate materials having high BET specific surface areas, such as silica. Thus, a fine particulate hydrophobic alumina, which is homogenized, which does not contain large amounts of agglomerates, and which has a high BET specific surface area, is still desired.

Japanese Patent Application Laid-Open No. 3-191363 discloses a toner containing hydrophobic abrasive γ-alumina in order to achieve uniform abrasive effects of alumina when an amorphous silicon photosensitive member is used. Thus, a toner containing such alumina does not simultaneously satisfy flowability and stabilized charging characteristics, although it has abrasive characteristics.

Currently, high definition and high quality of images are commercially required in copying machines. Achievement of high quality color images has been attempted using toners having smaller particle diameters. A finer toner having a larger specific surface area usually carries increased amounts of charge; hence, the image density may decrease and durability will deteriorate. Furthermore, highly charged toner particles have high bonding force, resulting in decreased flowability. As a result, toner supply is not stabilized and the supplied toner has insufficient triboelectric characteristics.

Since color toners do not contain magnetic substances and conductive substances such as carbon black, charges tend to increase without discharging. This phenomenon is particularly noticeable when a polyester binder having high charging characteristics is used.

The following are characteristics required for color toners:

(1) The fixed toner must almost completely melt to an extent in which the shape of toner particles are not recognized in order to prevent random scattering of light which decreases color reproducibility.

(2) Each color toner must have transparency so that an underlying different color toner layer is visible.

(3) Each color toner must have balanced hue and reflective characteristics, and have high color saturation.

Many binding resins have been researched to develop a toner satisfying the above-mentioned requirements. Polyester resins have been generally used as binding resins for color toners. Since temperature and humidity affect polyester resin-containing toners, these toners tend to be excessively charged in low-humidity environments, but are usually insufficiently charged in high-humidity environments. Accordingly, development of color toners having stabilized amounts of charges in various environments has been desired

SUMMARY OF THE INVENTION

Accordingly, it is an object of the present invention to provide a toner which does not have the above-mentioned problems.

It is another object of the present invention to provide a toner forming clear images without fogging, and having high image density, high reproducibility of fine lines and excellent gradation at a highlighted section.

It is still another object of the present invention to provide a toner having stable durability.

It is a further object of the present invention to provide a toner having high flowability, uniform charging characteristics, high development fidelity, and excellent transferring characteristics.

It is a still further object of the present invention to provide a toner which leaves little residue deposits on a photosensitive member, provides readily removed residual toner deposits on the photosensitive member, and stably forms an image without image defects.

It is another object of the present invention to provide a toner having stable triboelectric characteristics in any temperature or humidity environment.

It is still another object of the present invention to provide a toner having satisfactory fixing characteristics and high overhead projector transparency.

A toner in accordance with the present invention comprises toner particles and fine alumina particles, wherein a toner particle includes a binding resin and a colorant, and a fine alumina particle contains 200 to 700 $\mu$g of zirconium compound per gram of alumina.

Further objects, features and advantages of the present invention will become apparent from the following description of the preferred embodiments with reference to the attached drawing.

BRIEF DESCRIPTION OF THE DRAWINGS

FIG. 1 is a cross-sectional view of a developing unit using a nonmagnetic one-component toner in accordance with the present invention.

DESCRIPTION OF THE PREFERRED EMBODIMENTS

The present inventors have conducted intensive research in image densities of formed images, reproducibility of highlights and fine lines, durability when many copies are made, environmental stability, and, particularly, charging stability in a high-humidity environment, in order to eliminate the above-mentioned problems. As a result, the present inventors have discovered that a toner comprising fine alumina particles containing a particular amount of zirconium compounds has significantly stable environmental characteristics, satisfactory charging characteristics in high-humidity environments, high flowability, satisfactory transferring characteristics, and can suppress deposition of the toner on photosensitive members due to high abrasion and removability of the toner deposited onto the photosensitive members. Such a toner can produce high-definition and high-quality images.

A fine alumina particule as a constituent of the toner in accordance with the present invention contains 200 to 700 μg, and, preferably, 220 to 550 μg of zirconium compound per gram of alumina. In such amounts, the zirconium compound suppresses agglomeration of the fine alumina particle, and thus the toner maintains high flowability and satisfactory charging characteristics, and has improved abrasive characteristics. By adding the zirconium compound when the surface of the fine alumina particle is treated with a hydrophobic agent, the zirconium compound works as a reactive site with the hydrophobic agent and prevents self-condensation of the hydrophobic agent. Thus, the resulting fine alumina particle does not agglomerate, has high hydrophobicity, and is not affected by various environments.

The zirconium compound in the fine alumina particle functions as a controller which controls particle or crystal growth of the fine alumina particle. Thus, the resulting fine alumina particle has a desired particle diameter and a BET specific surface area. Furthermore, the alumina has a small difference between the number average particle diameter and the diameter of the particles corresponding to 75% of the cumulative number in the number distribution (hereinafter referred to as "75% cumulative particle diameter", and thus has a sharp unimodal particle diameter distribution even after the surface treatment.

When the content of the zirconium compound is less than 200 μg/g, agglomeration of the fine alumina particle is not sufficiently suppressed. The formed alumina agglomerate causes scuff marks on a drum surface, and thus causes image defects. Furthermore, an excessive amount of zirconium compound facilitates agglomeration of particles during an alumina drying step after hydrophobic treatment, and thus the particulate alumina has a broad particle diameter distribution which causes nonuniform charging of the toner.

When the amount of the zirconium compound is higher than 700 μg/g in the fine alumina particle, the excess zirconium compound forms many undesirable reactive sites, and thus the alumina does not have sufficient hydrophobicity. Such alumina is readily affected by environmental change.

It is preferable that the fine alumina particle in accordance with the present invention also contain 10 to 300 μg of zinc compound per gram of alumina. In such amounts, the zinc compound reacts with water in the fine alumina particle and functions as a reactive site with the hydrophobic agent. Thus, the resulting fine alumina particle has sufficiently high hydrophobicity. It is more preferable that the fine alumina particle contain 10 to 160 μg of zinc compound per gram of alumina.

Examples of zirconium compounds used in the present invention are shown in Table 1. The symbol M in Table 1 represents sodium, potassium or calcium. $M^I$ represents the element with a coordination number of 1 and $M^{II}$ represents the element with a coordination number of 2.

TABLE 1

| | |
|---|---|
| Oxides and relevant compounds thereof | $ZrO_2$, $ZrO_2 \cdot nH_2O$ (n = 1 to 3)<br>$M_mZrO_3$ (m = 1 or 2)<br>$ZrO_3 \cdot 2H_2O$<br>$K_4ZrO_4 \cdot 4H_2O_2 \cdot 2H_2O$ (peroxozirconate)<br>$Zr(OH)_3$, $Zr(OH)_4 \cdot nH_2O$ |

TABLE 1-continued

| | |
|---|---|
| Halides | $ZrCl_2$, $ZrBr_2$, $ZrI_2$<br>$ZrCl_3$, $ZrBr_3$, $ZrI_3$<br>$ZrF_4$, $ZrCl_4$, $ZrBr_4$, $ZrI_4$<br>$ZrOCl_2 \cdot 8H_2O$, $Zr_2O_3Cl_2$ |
| Oxy acid salts | $Zr(NO_3)_4 \cdot 5H_2O$, $ZrO(NO_3)_2 \cdot 2H_2O$<br>$Zr(SO_4)_2$, $Zr(SO_4)_2 \cdot 4H_2O$, $ZrO(SO_4)$<br>$ZrO(H_2PO_4)_2 \cdot 4H_2O$, $ZrP_2O_7$<br>$ZrSiO_4$ |
| Organic salts | $Zr(CH_3CO_2)_4 \cdot 4H_2O$, $ZrO(CH_3CO_2)_2$ |
| Interstitial Compounds | $ZrH_2$, ZrB, $ZrB_2$, $ZrB_{12}$, ZrC<br>$ZrSi_2$, ZrN, $Zr_3N_4$, ZrP, $ZrP_2$<br>$ZrS_2$, $ZrSe_2$ |
| Complexes | $M^I_2[ZrF_6]$, $M^{II}[ZrF_6]$ (hexafluorozirconates)<br>$M^I_4[ZrF_8]$, $M^{II}_2[ZrF_8]$ (octafluorozirconates)<br>$M^I_4[Zr(C_2O_4)_4]$, $M^{II}_2[Zr(C_2O_4)_4]$ (tetraoxalatezirconate)<br>$(C_6H_5)_2ZrBr_2$ |

Examples of zinc compounds used in the present invention are shown in Table 2. The symbol M in Table 1 represents sodium and potassium.

TABLE 2

| | |
|---|---|
| Hydride | $ZnH_2$ |
| Oxides and relevant compounds thereof | ZnO, $Zn(OH)_2$, $M^I_2[Zn(OH)_4]$<br>$ZnAl_2O_4$ |
| Halides and halide complexes | $ZnF_2$, $ZnCl_2$, $ZnBr_2$, $ZnI_2$<br>$M^I[ZnX_3]$, $M^I_2[ZnX_4]$<br>(X = halogen) |
| Oxy acid salts | $Zn(SO_4)_2$, $Zn(NO_3)_2$, $Zn_3(PO_4)_2$<br>$ZnCO_3$, $ZnSiO_4$ |
| Organic Zinc Compounds | $(CH_3)_2Zn$, $(C_6H_6)_2Zn$, $CH_3ZnI$<br>$Zn_4O(CH_3CO_2)_6$, $Zn(CN)_2$ |
| Miscellaneous | $M^I_2[Zn(CN)_4]$, $Zn_8N_2$, $[Zn(NH_3)_n]X_2$<br>(n = 4 or 6, X = halogen) |

In the present invention, the zirconium and zinc compounds may be added when a fine alumina particle is formed or when the fine alumina particle is subjected to surface treatment. These compounds are preferably added when the fine alumina particle is subjected to surface treatment, so that the fine alumina particle has a more uniform particle diameter distribution. The zirconium and zinc compounds may be adhered or bonded to the surface of the fine alumina particle or may be included in the interior of the fine alumina particle.

In the present invention, the fine alumina particle has a number average particle diameter of preferably 1 to 100 nm, and more preferably 1 to 70 nm, in view of flowability and abrasive characteristics of the resulting toner. When the number average particle diameter is less than 1 nm, the fine alumina particle is readily embedded in the surface of the toner particles. In such a state, the toner does not have satisfactory abrasive characteristics and decreased durability due to rapid deterioration. On the other hand, when the number average particle diameter of the fine alumina particle is greater than 100 nm, the toner lacks flowability and causes nonuniform charging, resulting in inferior image quality, toner scattering, and fogging. Furthermore, such toner may form large flaws on the surface of a photosensitive member, or may deform or damage cleaning members such as a cleaning blade.

It is preferable that the fine alumina particle have a sharp unimodal particle diameter distribution and that the difference between the number average particle diameter and the 75% cumulative particle diameter be in a range of 3 to 40 nm. A difference larger than 40 nm represents a broad particle diameter distribution and formation of many large particles. Such alumina causes low flowability of the resulting toner or ready formation of flaws on the surface of a photosensitive member. A difference of less than 3 nm for the fine alumina particle requires a long production time.

The fine alumina particles in accordance with the present invention have a BET specific surface area in a range of preferably 100 to 350 $m^2/g$, and more preferably 150 to 300 $m^2/g$. When the BET specific surface area lies in such a range, the fine alumina particle imparts sufficient flowability and environmental stability to the toner. In particular, reduction in charging of the toner under high-humidity environments can be suppressed. Since a fine alumina particle having such a BET specific surface area generally has a desirable particle diameter, the alumina does not contain large amounts of agglomerates. The resulting toner hardly damages the surface of a photosensitive member and a cleaning means (including a cleaning blade) due to the small amounts of residual toner deposited on the surface of the photosensitive member.

When a fine alumina particle having a small average particle diameter and high abrasive effects is treated with a hydrophobic agent, which is highly reactive with the alumina, such as an organic silane compound, or when a fine alumina particle is thoroughly dispersed in a solvent and then fired, the resulting fine alumina particle can impart high flowability, high charging characteristics, and high abrasive characteristics to toners.

The fine alumina particle used in the present invention may be formed from any suitable alumina source and by any method. Examples of preferable fine alumina particle include a fine particulate γ-alumina prepared by pyrolysis of aluminum ammonium carbonate hydroxide at a temperature of 300 to 1,200° C., and a fine particulate amorphous alumina. In the γ-alumina and amorphous (a) alumina, particle parameters, such as particle diameter, size distribution, and BET specific surface area, can be readily controlled to desirable ranges.

Since fine α-alumina particles generally have a large particle diameter and a small BET specific surface area, the toner using the α-alumina may not have high flowability and may damage the surface of the photosensitive member.

It is preferable in the present invention that the fine alumina particle be subjected to hydrophobic treatment. When the fine alumina particle contains a zirconium compound or a zirconium compound and a zinc compound, it is preferable that a mixture of fine alumina particles, a zirconium compound, and a zinc compound, if necessary, be subjected to hydrophobic treatment, because the zirconium and zinc compounds react with the hydrophobic agent. As a result, the fine alumina particle has an increased hydrophobicity and improved environmental stability.

Preferably, the fine alumina particle has a hydrophobicity in a range of 40% to 90%. When the hydrophobicity is less than 40% due to insufficient hydrophobic treatment, the toner has poor discharging characteristics particularly in high-humidity environments, resulting in undesired toner scattering, fogging, and deterioration of image quality. When the hydrophobicity is greater than 90%, the fine alumina particle cannot adequately control charging. This results in over-charging of toners, particularly in low-humidity environments. Furthermore, particles after the hydrophobic treatment readily form agglomerates, which results in low flowability of toners.

Examples of hydrophobic treatment of the fine alumina particle with a hydrophobic agent such as a silane-coupling agent will now be described. Any other method can also be employed in the present invention without limitation.

For example, a fine alumina particle is dispersed into a solvent by a mechanical process, while a zirconium compound, a zinc compound as an optional component, and a hydrophobic agent such as a silane coupling agent are added. A hydrophobic fine alumina particle is prepared by hydrolysis.

In a wet hydrophobicity-imparting process, a predetermined amount of fine alumina particle is stirred in an aqueous solvent, and a predetermined amount of zirconium compound and a predetermined amount of zinc compound, if necessary, are added. Next, a predetermined amount of hydrophobic agent or a dilute solution thereof is gradually added thereto, while thoroughly stirring the solution so as not to agglomerate the particles. The fine alumina particle, after the hydrophobic treatment, is dried and pulverized. The characteristic advantages in the present invention are best achieved by the gradual addition of the hydrophobic agent to the fine alumina particle.

In a dry hydrophobicity-imparting process, a fine alumina particle containing a predetermined amount of zirconium, and a predetermined amount of zinc compound, if necessary, is thoroughly combined in a mixer, such as a blender, while a predetermined amount of hydrophobic agent or a solution thereof is gradually added thereto by any means. The mixture is then dried by heating. The resultant mass is further stirred for pulverization in a mixer, such as a blender.

A fine alumina particle having desirable hydrophobicity may be prepared by hydrophobic treatment using two or more hydrophobic agents. For example, hydrophobic treatment is performed using mixed hydrophobic agents of $n\text{-}C_4H_9\text{—}Si\text{—}(OCH_3)_3$ and $C_{12}H_{25}\text{—}Si\text{—}(OCH_3)_3$, the hydroxyl groups on the surface of the particulate alumina first react with the (lower) hydrophobic agent having smaller numbers of carbon atoms, and then with the (higher) hydrophobic agent having larger numbers of carbon atoms. The resulting fine particulate hydrophobic alumina imparts desirable properties to toners.

Any organic silane compound may be used in the present invention depending on the purpose of surface modification (for example, control of charging characteristics and stabilization of charging in high-humidity environments), and on the reactivity of the organic silane compound with the fine alumina particle. Examples of preferable organic silane compounds include compounds which do not degrade at reaction temperatures, such as alkoxy silanes, alkylalkoxy silanes, siloxanes, silanes, and silicone oils.

Volatile alkoxysilanes having both hydrophobic groups and reactive groups, such as silane coupling agents, are more preferable.

Preferable silane coupling agents are represented by the general formula:

$$R_mSiY_n$$

wherein R is an alkoxy group having 1 to 16 carbon atoms; Y is an alkyl group, a vinyl group, a phenyl group, a methacrylic group, an amino group, an epoxy group, a mercapto group, and an derivative thereof; m is an integer of 1 to 3; and n is an integer of 1 to 3. Examples of the preferable silane-coupling agents include vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

The silane-coupling agent is added in an amount of, preferably 1 to 60 parts by weight, and more preferably 3 to 50 parts by weight with respect to 100 parts by weight of fine alumina particle.

More preferable silane coupling agents in the present invention are represented by the general formula:

$$C_nH_{2n+1}—Si—(OC_mH_{2m+1})_3$$

wherein m is an integer of 1 to 3; and n is an integer of 4 to 12. When n is less than 4, the resulting fine alumina particle does not have a sufficiently high hydrophobicity, although the hydrophobic treatment can be smoothly performed. When n is greater than 12, the resulting toner loses flowability due to agglomeration of alumina particles, although the alumina has a sufficiently high hydrophobicity. When m is greater than 3, the resulting fine alumina particle does not have a sufficiently high hydrophobicity due to low reactivity. Accordingly, in the present invention n is in a range of 4 to 12 and preferably 4 to 8, and m is in a range of 1 to 3, and preferably 1 or 2.

The more preferable silane coupling agent is added in an amount of, preferably 1 to 50 parts by weight, and more preferably 3 to 40 parts by weight with respect to 100 parts by weight of fine alumina particle.

The fine alumina particle content in the toner in accordance with the present invention is in a range of 0.1 to 5 percent by weight based on the weight of toner. When the content is less than 0.1 percent by weight, the toner does not have high flowability and sufficient abrasive characteristics. When the content is greater than 5 percent by weight, the toner has excessive flowability, resulting in nonuniform charging, excessively high abrasive characteristics, and lowered drum durability.

According to research by the present inventors, toner particles having a weight average particle diameter of 3 to 9 μm are more effective for improvement in stability of the image density, highlight reproducibility, fine line reproducibility, and environmental stability. That is, a toner containing the above-mentioned fine alumina particle and having a weight average particle diameter of 3 to 9 μm can properly develop a latent image formed on a photosensitive member.

A toner having a weight average particle diameter of greater than 9 μm contains a relatively low content of fine particle component which fine particle component contributes to formation of high-quality images, although it has high image density and high flowability. Thus, the toner is not exactly deposited onto a latent image formed on a photosensitive member, resulting in low highlight reproducibility and low resolution. Furthermore, the toner tends to be excessively deposited onto the latent image in the development process, resulting in rapid toner consumption.

A toner having a weight average particle diameter of less than 3 μm provides decreased image density, particularly in low-temperature, low-humidity environments, due to an extremely high amount of charge per unit weight of toner. Such a toner is unsuitable for copying documents having a high image area ratio, such as graphic images. Furthermore, when such a toner is applied to a two-component developing process, contact charging between the toner and a carrier is insufficient. Thus, scattering of the toner in non-imaged sections; that is, fogging is noticeable due to an increase in uncharged toner particles. A toner having a weight average particle diameter of less than 3 μm readily agglomerates even in combination with a fine carrier having a larger specific surface area. Thus, mixing of the toner and the carrier is not achieved within a short period, and fogging inevitably occurs in a continuous toner supply mode.

A toner having high resolution and high gradation can be produced by providing a weight average particle diameter within the above range and by using the above-mentioned fine alumina particle which has high flowability, high charging characteristics and desirable abrasive characteristics, and which is not affected by humidity. The resulting toner can yield high-definition images regardless of the copying environment.

Each of fine toner particles has a small amount of charge, and thus the toner generally tends to scatter. The toner in accordance with the present invention containing the fine alumina particle has high flowability and stabilized charging characteristics.

The agglomeration factor of the toner is in a range of 2 to 40%, preferably 2 to 35%, and more preferably 2 to 30%, in the present invention. When the agglomeration factor is greater than 40%, the toner may have disadvantages, such as unsuccessful transfer from a toner hopper to a developer, insufficient mixing with a carrier, and unsuccessful charging. Even if such a toner is pulverized to optimize coloring ability of the toner, the toner will not yield high-quality images.

Any conventional binding resin for electrophotographic toners can be used as a colorant-containing particulate resin contained in the toner in accordance with the present invention. Examples of such binding resins include styrenic polymers, e.g., polystyrenes, styrene-butadiene copolymers, and styrene-acrylate copolymers; ethylenic polymers, e.g., polyethylene, ethylene-vinyl acetate copolymers, and ethylene-vinyl alcohol copolymers; and miscellaneous resins, e.g., phenol resins, epoxy resins, acrylphthalate resins, polyamide resins, polyester resins, and maleic resins. Methods for producing these resins are not limited.

Advantages of the present invention are particularly noticeable when polyester resins having high negatively chargeable characteristics are used. Polyester resins have satisfactory fixing characteristics suitable for color toners, whereas they show excess negative charging. The toner composition in accordance with the present invention, however, offsets the disadvantages of the polyester resins.

The polyester resins preferably used in the present invention are composed of 45 to 55 mole percent of polyvalent alcohol component and 55 to 45 mole percent of polyvalent acid component.

Examples of polyvalent alcohol components include diols, such as ethylene glycol, propylene glycol, 1,3-butanediol, 1,3-butanediol, 2,3-butanediol, diethylene glycol, triethylene glycol, 1,5-pentanediol, 1,6-hexanediol, neopentyl glycol, 2-ethyl-1,3-hexane diol, hydrogenated bisphenol A, bisphenol derivatives represented by the formula (I):

(I)

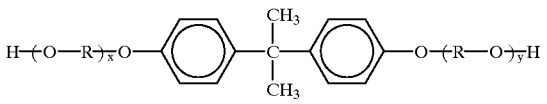

wherein R is a ethylene or propylene group, x and y are each an integer of 1 or more, and x+y is 2 to 10, and diols represented by the formula (II):

(II)

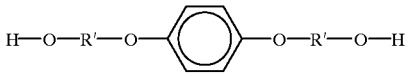

wherein R' represents

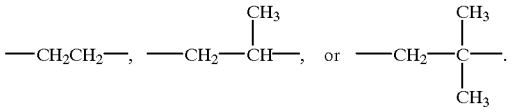

Examples of polyvalent alcohol components also include polyols which are trivalent or higher, such as glycerin, sorbitol, sorbitan, and pentaerythritol.

The polyvalent acid component contains at least 50 mole percent divalent carboxylic acids. Examples of such divalent carboxylic acids include benzenedicarboxylic acids and anhydrides thereof, e.g., phthalic acid, isophthalic acid, and phthalic anhydride; alkyldicarboxylic acids and anhydrides thereof, e.g., succinic acid, adipic acid, sebacic acid, and azelaic acid; succinic acid having an alkyl or alkenyl group of 6 to 18 carbon atoms and anhydride thereof; and unsaturated dicarboxylic acids and anhydrides thereof, e.g., fumaric acid, maleic acid, citraconic acid, and itaconic acid.

Tricarboxylic acids may be used with the above dicarboxylic acids. Examples of tricarboxylic acids include trimellitic acid, pyromellitic acid, monomethyl trimellitate, naphthalenetricarboxylic acid, and 1,2,4-cyclohexanetricarboxylic acid.

Preferable polyester resins having sharp melting characteristics are prepared by polycondensation of the bisphenol derivatives represented by the formula (I) as diol components and the above-mentioned carboxylic acids.

Colorants used for nonmagnetic toners in accordance with the present invention may be any conventional dye or pigment. Examples of such dyes and pigments include Phthalocyanine Blue, Indanthrene Blue, Peacock Blue, Permanent Red, Lake Red, Rhodamine Lake, Hansa Yellow, Permanent Yellow, and Benzidine Yellow. The dye or pigment content is in a range of 12 parts by weight or less, and preferably 0.5 to 9 parts by weight with respect to 100 parts by weight of binding resin, in view of transparency of copied portions on overhead projector films.

Magnetic materials as colorants can be used in magnetic toners. The content of the magnetic material is preferably in a range of 10 to 200 parts by weight with respect to 100 parts by weight of binding resin.

The toner in accordance with the present invention may be a negatively chargeable toner or a positively chargeable toner. When a negatively chargeable toner is prepared, a negative-charge controller is preferably used to stabilize negatively chargeable characteristics. Examples of negative charge controllers include organometallic complexes, such as metal complexes of alkylsalicylic acids, e.g., chromium or zinc complex of di-tert-butylsalicylic acid.

When a positively chargeable toner is prepared, a positive charge-imparting controller is used. Examples of positive charge-imparting controllers include nigrosine, triphenylmethane compounds, Rhodamine dyes, and polyvinylpryridine. Colorless or pale-color positive charge-imparting controllers are preferably used for color toners so that the tone of the toner is not affected.

The toner in accordance with the present invention may contain any additive within the scope in which toner characteristics are lost. Examples of additives include charge auxiliaries, e.g., organic particles and metal oxides; lubricants, e.g., polytetrafluoroethylene (Teflon), zinc stearate, and polyvinylidene fluoride; and fixing auxiliaries, e.g., low molecular polyethylene and low molecular polypropylene.

Methods for making colorant-containing resin particles or a toner in accordance with the present invention include mixing raw materials in a mixer such as hot rollers, a kneader or an extruder, pulverizing the mixture, and then classifying the powder; dispersing raw materials including a colorant into a binding resin solution, spraying and then drying the solution; or emulsion polymerization of a monomer composition containing toner constituents wherein the monomer forms a binding resin by the polymerization.

When the toner in accordance with the present invention is used as a two-component developer, a carrier is used together therewith. Carriers preferably used are powdered metals. Examples of metals for carriers include iron, surface-oxidized iron, nickel, copper, zinc, cobalt, manganese, chromium, and rare earth metals. These metal carriers may be produced by any process.

Coating of the carrier surface with a resin may be performed by any conventional process, for example, by dissolving or dispersing a coating material such as resin into a solvent and then coating the carrier surface with the solution, or by mixing the carrier with the coating material.

Various materials are coated on the carrier surface depending on the toner materials. Examples of such materials include polytetrafluoroethylene, monochorotrifluoroethylene polymers, polyvinylidene fluoride, silicone resins, polyester resins, metal complexes of di-tert-butylsalicylic acid, styrene resins, acrylic resins, polyamide resin, polyvinyl butyral, nigrosine, aminoacrylate resins, basic dyes and lakes thereof, fine particulate silica, and fine alumina particle. These materials may be used alone or in combination.

These materials are added in a total amount of 0.1 to percent by weight and more preferably 0.5 to 20 percent by weight with respect to the carrier. Each of these carriers has a number average particle diameter of preferably 10 to 100 $\mu$m and more preferably 20 to 70 $\mu$m.

A preferable carrier is a coated ferrite carrier composed of Cu—Zn—Fe ternary ferrite. The surface of the ternary ferrite particle is coated with a resin component composed of a silicone resin and a fluorine resin, for example, polyvinylidene fluoride and a styrene-methyl methacrylate resin, or polytetrafluoroethylene and a styrene-methyl methacrylate resin, composed of a fluorine resin and a styrenic copolymer, or composed of a silicone resin. In the resin mixture, these two components are added in a ratio of 90:10 to 20:80, and preferably 70:30 to 30:70. The resin component is added in amount of 0.01 to 5 percent by weight and preferably 0.1 to 1 parts by weight based on the coated ferrite carrier. Furthermore, the coated ferrite carrier has an average particle diameter in which carrier particles passing through 250-mesh and not passing through 400-mesh occupy 70 percent by weight or more of the coated carrier. Examples of fluorine copolymers include vinylidene fluoride/tetrafluoroethylene copolymers (10:90 to 90:10), and examples of styrenic copolymers include styrene/2-ethylhexyl acrylate (20:80 to 80:20) and styrene/2-ethylhexyl acrylate/methyl methacrylate (20 to 60:5 to 30:10 to 50). When the coated ferrite carrier has a sharp unimodal particle diameter distribution, the toner has desirable triboelectric characteristics and improved electrophotographic characteristics.

When a two-component developer is prepared using the toner in accordance with the present invention and the carrier, the toner content in the developer is in a range of 2 to 15 percent by weight, preferably 3 to 13 percent by weight, and more preferably 4 to 10 percent by weight. When the toner content is less than 2 percent by weight, the image density is low and is unsatisfactory. When the toner content is greater than 15 percent by weight, fogging occurs and the toner significantly scatters in a copying machine. Furthermore, the developer has a shortened life.

A developing unit for performing a nonmagnetic one-component development using a toner in accordance with the present invention will now be described with reference to FIG. 1. Developing units other than that shown in FIG. 1 are also usable in the present invention. In FIG. 1, a latent image is formed on a latent image holder 1 by an electrophotographic process or an electrostatic recording means (not shown in the drawing). The latent image holder 1 includes a nonmagnetic sleeve composed of aluminum or stainless steel. A nonmagnetic one-component color toner is contained in a hopper 3, and supplied to a developer holder 2 by a supply roller 4. The supply roller 4 scrapes away the residual toner from the developer carrier after development. A developer-coating blade 5 spreads the toner supplied on the developer holder 2 to form a thin uniform toner layer on the developer holder 2. The contact pressure between the developer-coating blade 5 and the developer holder 2 as a line pressure in the generating line direction of the sleeve is in a range of 3 to 250 g/cm and preferably to 120 g/cm. The toner is not uniformly applied when the contact pressure is less than 3 g/cm. Thus, the toner has a broad charging distribution causing fogging and scattering. When the contact pressure is higher than 250 g/cm, toner particles agglomerate or are pulverized. A contact pressure in the above range satisfactorily disintegrates toner agglomeration and facilitates instantaneous triboelectric charging of the toner.

The developer-coating blade 5 is preferably composed of a material which can charge the toner to a required polarity. In the present invention, silicone rubbers, urethane rubbers, and styrene-butadiene rubbers are preferable. Conductive rubbers are preferably used to prevent excess triboelectric charging of the toner. A surface-coated developer-coating blade 5 may be used, if necessary. When a negative toner is used, the developer-coating blade 5 is preferably coated with a positively chargeable resin, such as a polyamide resin.

When a thin layer toner is coated on the developer holder 2 using the developer-coating blade 5, it is preferable that the thickness of the toner layer on the developer holder 2 be less than the gap between the developer holder 2 and the latent image holder 1 and that an AC voltage be applied therebetween to form a high image density. When an AC voltage or a DC current-superimposed AC voltage (a bias voltage) is applied between the developer holder 2 and the latent image holder 1 through a bias electrical power source 6, the toner is smoothly transferred from the developer holder 2 to the latent image holder 1 and thus an excellent image can be formed.

Methods for measuring various parameters in the present invention will now be described.

1. Zirconium and Zinc Contents in Fine Alumina Particle

After a fine alumina particle sample is decomposed with an acid, the solution is subjected to qualitative and quantitative analysis by high frequency induction coupled plasma emission spectrophotometry. The spectrophotometer used is SPS-400 made by Seiko Instruments Inc.

2. BET Specific Surface Area of Fine Alumina Particle

The BET specific surface area is determined by a BET multipoint method using nitrogen as absorbed gas in a full-automatic gas adsorption meter "AUTOSORB 1" made by Yuasa Ionics Co. Ltd. The sample is previously deaerated at 50° C. for 10 hours.

3. Average Particle diameter of Fine Alumina Particle

Diameters of 300 fine alumina particles in a field are measured using a transmittance electron microscope (TEM) and the average thereof is calculated. Diameters of 300 alumina particles on toners in a field are measured using a scanning electron microscope (SEM) and the average thereof is calculated.

4. Hydrophobicity of Fine Alumina Particle

The hydrophobicity of fine alumina particle is determined by methanol titrimetric analysis which is a trial process for measuring the hydrophobicity of powdered inorganic compounds having hydrophobic surfaces. Into a 250-ml Erlenmeyer flask containing 50-ml water is placed 0.2 g of a fine alumina particle. The aqueous solution is titrated with methanol using a buret, while the solvent is stirred with a magnetic stirrer. The end point of sedimentation of the fine alumina particle is confirmed by complete suspension of the fine alumina particle in the solvent. The hydrophobicity corresponds to the percentage of methanol in the mixed solution of methanol and water at the end point of the sedimentation.

5. Particle diameter Distribution of Toner

An apparatus used is a Coulter Counter TA-II or a Coulter Multiatomizer II made by Coulter Co. As an electrolytic solution, approximately 1-% NaCl solution is prepared using chemical grade sodium chloride. In the present invention, for example, ISOTON-II made by Coulter Scientific Japan can be used as an electrolytic solution. Into 100 to 150 ml of electrolytic solution, 0.1 to 5 ml of surfactant as a dispersant (an alkylbenzenesulfonate salt is preferable) is added and then 2 to 20 g of toner sample is added. The electrolytic solution is subjected to dispersion treatment for approximately 1 to 3 minutes in an ultrasonic agitator. Using a 100-$\mu$m aperture, the volume and number of the toner particles are measured for each channel in the apparatus to calculate the volume distribution and the number distribution of the toner particles. Finally, the weight average particle diameter (D4) of the toner particles is calculated from the volume distribution, wherein the medial value in each channel is used as a representative value in the channel.

The following thirteen channels are used: 2.00 to 2.52 $\mu$m; 2.52 to 3.17 $\mu$m; 3.17 to 4.00 $\mu$m; 4.00 to 5.04 $\mu$m; 5.04 to 6.35 $\mu$m; 6.35 to 8.00 $\mu$m; 8.00 to 10.08 $\mu$m; 10.08 to 12.70 $\mu$m; 12.70 to 16.00 $\mu$m; 16.00 to 20.20 $\mu$m; 20.20 to 25.40 $\mu$m; 25.40 to 32.00 $\mu$m; and 32.00 to 40.30 $\mu$m.

6. Agglomeration Factor

The agglomeration factor in the present invention is an index of flowability of a toner containing external additives. The larger the agglomeration factor, the lower the flowability.

A powder tester (made by Hosokawa Micron Corporation) provided with a digital vibroscope (DEGIVIBRO MODEL 1332) is used. A 200-mesh screen, a 100-mesh screen, and a 60-mesh screen are placed, in that order, on a vibration table. On the top 60-mesh screen, 5 g of an exactly weighed sample is placed. Next, 21.7 volts are applied to the vibration table, and the displacement of the digital vibroscope is set to be 0.090 so that the amplification of the vibration table lies within a range of 40 to 70 $\mu$m (corresponding to approximately 2.5 on the rheostat scale). The vibration is continued for approximately 15 seconds. The weight of the sample remaining on each screen is measured, and the agglomeration factor is calculated by the following equation:

$$\text{Agglomeration factor (\%)} = \{(\text{Weight of sample on 60-mesh screen})/5\,g\} \times 100 + \{(\text{Weight of sample on 100-mesh screen})/5\,g\} \times 100 \times (3/5) + \{(\text{Weight of sample on 200-mesh screen})/5\,g\} \times 100 \times (1/5)$$

The sample is allowed to stand for 12 hours in a 60%-humidity environment prior to the measurement. The measurement is performed at 23° C. and 60% humidity.

7. Crystal Structure of Fine Alumina Particle

The crystal structure of a fine alumina particle is determined by Cu—Kα X-ray diffractometry using a high-power automatic X-ray diffractometer MXP18 made by McScience Co.

The α-crystal structure of the alumina is confirmed by sharp characteristic peaks at 2θ=20 to 70 deg.

EXAMPLES

The present invention will now be described in more detail with reference to the following EXAMPLES.

Preparation of Fine Alumina Particle 1

Two liters of 0.2M ammonium aluminum alum solution was added dropwise into three liters of 2M ammonium bicarbonate at a rate of 0.8 liter/hour while maintaining the liquid temperature at 30° C. and thoroughly stirring. The resultant fine aluminum ammonium carbonate hydroxide particle was filtered and was dried. The product was pulverized in a speed mill so that the average particle diameter becomes 10 nm. The powder was heated at 900° C. for 24 hours and pulverized to form a fine alumina particle. The fine alumina particle had a BET specific surface area of 280 $m^2/g$, an average particle diameter of 7 nm, and a 75% cumulative particle diameter of 11 nm. The results of X-ray diffractometry showed that the crystal structure was γ-crystal.

The fine alumina particle was thoroughly wet-pulverized with toluene in a ball mill using alumina balls with a diameter of 5 mm, and then 5 parts by weight of $Zr(OH)_4.xH_2O$ and 5 parts by weight of $Na[Zn(OH)_3]$ with respect to 100 parts by weight of fine alumina particle were added to the dispersion. Next, 30 parts by weight (solid component) of $i\text{-}C_4H_9—Si—(OCH_3)_3$ as a hydrophobic agent with respect to 100 parts by weight of fine alumina particle was added dropwise to the dispersion while maintaining the temperature at 50° C. and thoroughly stirring to hydrolyze the fine alumina particle. The product was filtered, dried, and then baked at 180° C. for 2 hours. The resultant was pulverized in a speed mill to form Fine Alumina Particle 1. Properties of the fine alumina particle are shown in Table 3.

Preparation of Fine Alumina Particle 2

Fine Alumina Particle 2 was prepared as in Fine Alumina Particle 1, wherein 3 parts by weight of $Zr(OH)_4.xH_2O$ with respect to 100 parts by weight of fine alumina particle was added, and $Na[Zn(OH)_3]$ was not added.

Preparation of Fine Alumina Particle 3

Two liters of 0.2M ammonium aluminum alum solution was added dropwise into three liters of 2M ammonium bicarbonate at a rate of 0.8 liter/hour while maintaining the liquid temperature at 30° C. and thoroughly stirring. Next, 5 parts by weight of $Zr(OH)_3$ and 5 parts by weight of $Zn(OH)_2$ with respect to 100 parts by weight of fine alumina particle were added to the dispersion while stirring. The dispersion was filtered, and dried. The product was pulverized in a speed mill so that no agglomerate was observed and fine particles having a primary particle diameter of 80 nm or more were 5% by number or less. The powder was heated at 900° C. for 24 hours and pulverized to form a fine alumina particle. The fine alumina particle had a BET specific surface area of 260 $m^2/g$, and an average particle diameter of 8 nm. The content of particles having a particle diameter of 1 to 60 nm was 99% by number. The results of X-ray diffractometry showed that the crystal structure was γ-crystal.

The fine alumina particle was thoroughly wet-pulverized with toluene in a ball mill using alumina balls with a diameter of 5 mm, and 30 parts by weight (solid component) of $i\text{-}C_4H_9—Si—(OCH_3)_3$ as a hydrophobic agent with respect to 100 parts by weight of fine alumina particle was added dropwise to the dispersion while maintaining the temperature at 50° C. and thoroughly stirring to hydrolyze the fine alumina particle. The product was filtered, dried, and then baked at 180° C. for 2 hours. The resultant was pulverized in a speed mill to form Fine Alumina Particle 3.

Preparation of Fine Alumina Particle 4

Fine Alumina Particle 4 was prepared as in Fine Alumina Particle 3, wherein 7 parts by weight of $Zr(OH)_3$ with respect to 100 parts by weight of fine alumina particle was added, and $Zn(OH)_2$ was not added.

Preparation of Fine Alumina Particle 5

Fine Alumina Particle 5 was prepared as in Fine Alumina Particle 1, wherein 1.3 parts by weight of $Zr(OH)_4.xH_2O$ and 1.3 parts by weight of $Na[Zn(OH)_3]$ with respect to 100 parts by weight of fine alumina particle were added.

Preparation of Fine Alumina Particle 6

Fine Alumina Particle 6 was prepared as in Fine Alumina Particle 1, wherein 9.5 parts by weight of $Zr(OH)_4.xH_2O$ and 9.5 parts by weight of $Na[Zn(OH)_3]$ with respect to 100 parts by weight of fine alumina particle were added.

Preparation of Fine Alumina Particle 7

Fine Alumina Particle 7 was prepared as in Fine Alumina Particle 1, wherein the powder was heated at 1,100° C. for 24 hours.

Preparation of Fine Alumina Particle 8

Fine Alumina Particle 8 was prepared as in Fine Alumina Particle 1, wherein 8 parts by weight (solid component) of $i\text{-}C_4H_9—Si—(OCH_3)_3$ with respect to 100 parts by weight of fine alumina particle was added.

Preparation of Fine Alumina Particle 9

Fine Alumina Particle 9 was prepared as in Fine Alumina Particle 3, wherein 5 parts by weight of $Na[Zn(OH)_3]$ with respect to 100 parts by weight of fine alumina particle was added in the hydrophobic treatment.

Preparation of Fine Alumina Particle 10

Fine Alumina Particle 10 was prepared as in Fine Alumina Particle 1, wherein the powder was heated at 1,150° C. for 36 hours, and 55 parts by weight (solid component) of $i\text{-}C_4H_9—Si—(OCH_3)_3$ of fine alumina particle was added.

Preparation of Fine Alumina Particle 11

Fine Alumina Particle 11 was prepared as in Fine Alumina Particle 1, wherein the powder was heated at 750° C., and 12 parts by weight (solid component) of $i\text{-}C_4H_9—Si—(OCH_3)_3$ was added.

Preparation of Fine Alumina Particle 12

Fine Alumina Particle 12 was prepared as in Fine Alumina Particle 3, wherein 2 parts by weight of $Zr(OH)_4.xH_2O$ with respect to 100 parts by weight of fine alumina particle was added in the hydrophobic treatment.

Preparation of Fine Alumina Particle 13

Fine Alumina Particle 13 was prepared as in Fine Alumina Particle 1, wherein $Zr(OH)_4.xH_2O$ and $Na[Zn(OH)_3]$ were not added.

Preparation of Fine Alumina Particle 14

Fine Alumina Particle 14 was prepared as in Fine Alumina Particle 1, wherein 0.6 parts by weight of $Zr(OH)_4.xH_2O$ and 0.4 parts by weight of $Na[Zn(OH)_3]$ were added.

Preparation of Fine Alumina Particle 15

Fine Alumina Particle 15 was prepared as in Fine Alumina Particle 1, wherein 12 parts by weight of $Zr(OH)_4.xH_2O$ and 10 parts by weight of $Na[Zn(OH)_3]$ were added.

Preparation of Fine Alumina Particle 16

One hundred parts by weight of fine particulate γ-alumina, which was prepared by high-temperature hydrolysis of anhydrous aluminum chloride and had an average particle diameter of 21 nm, was dispersed into toluene, and then pulverized in a ball mill with alumina balls with a diameter of 5 mm. Next, 13 parts by weight (solid component) of $i\text{-}C_4H_9\text{—}Si\text{—}(OCH_3)_3$ as a hydrophobic agent with respect to 100 parts by weight of fine alumina particle was added dropwise to the dispersion while maintaining the temperature at 50° C. and thoroughly stirring to hydrolyze the fine alumina particle. The product was filtered, dried, and then baked at 180° C. for 3 hours. The resultant was pulverized in a speed mill to form Fine Alumina Particle 16.

Example 1

| | |
|---|---|
| Polyester resin prepared by condensation of propoxylated bisphenol, fumaric acid, and pyromellitic acid | 100 parts by weight |
| Phthalocyanine pigment | 4 parts by weight |
| Chromium complex of di—tert-butylsalicylic acid | 4 parts by weight |

The above components were preliminarily mixed in a Henschel mixer, and were kneaded in a biaxial extruding kneader. The mixture was cooled, roughly pulverized in a hammer mill to approximately 1 to 2 mm, and then finely pulverized by an air-jet process. The fine particles were classified. A negatively chargeable cyan toner particle having a weight average particle diameter of 6.0 μm was thereby prepared in which the toner particle contains 21.3% of particles of 4.0-μm or less, 48.5% of particles of 5.04-μm or less, 6.1% of particles of 8.0-μm or more, and 0.6% of particles of 10.08-μm or more.

One hundred parts by weight of the cyan toner particle and one part by weight of Fine Alumina Particle 1 were mixed in a Henschel mixer to prepare a cyan toner.

The cyan toner was mixed with a silicone resin-coated carrier to prepare a developer having a toner content of 6%. Copying operation was performed by 10,000 times a color copying machine CLC-800 (made by Canon Corp.) using an original having an image area ratio of 15% in a high-temperature (32.5° C.), high-humidity (85%) environment, and a normal-temperature (23° C.), low-humidity (5%) environment. The results of the copying tests based on the standards described below are shown in Table 4.

Changes in image density, fogging, and toner charging were significantly small during the copying operations. Toner scattering after 10,000 copies was negligible. Deposits and defects were not found in scanning electron microscopic observation of the photosensitive member surface after 10,000 copying operations.

Example 2

Tests were performed as in Example 1, but using Fine Alumina Particle 2. A change in toner discharging after 10,000 copying operations was small. High-definition images having high image density and sufficient highlight reproducibility were obtained without fogging or toner scattering. Deposits and defects were not found on the photosensitive member surface.

Example 3

Tests were performed as in Example 1, but using Fine Alumina Particle 3. Uniformity of toner charging was slightly decreased after 10,000 copying operations. Thus, the image density was slightly decreased, and fogging occurred with slight toner scattering. These phenomena, however, were not problems of practical significance. Deposits and defects causing any problem in use were not found on the photosensitive member surface.

Example 4

Tests were performed as in Example 1, but using Fine Alumina Particle 4. Uniformity of toner charging was slightly decreased after 10,000 copying operations. Thus, the image density was slightly decreased, and fogging occurred with slight toner scattering. These phenomena, however, were not problems of practical significance. No deposits and defects causing problems in use were found on the photosensitive member surface.

Example 5

Tests were performed as in Example 1, but using Fine Alumina Particle 5. Uniformity of toner charging was slightly decreased after 10,000 copying operations. Thus, the image density was slightly decreased in the low-humidity environment, and fogging occurred with slight toner scattering. These phenomena, however, were not problems of practical significance. Although defects due to agglomeration of fine alumina particle were found on the photosensitive member surface, image defects did not occur.

Example 6

Tests were performed as in Example 1, but using Fine Alumina Particle 6. Uniformity of toner charging was slightly decreased after 10,000 copying operations. Thus, the image density was slightly decreased in the low-humidity environment, and fogging occurred with slight toner scattering. These phenomena, however, were not problems of practical significance. Although defects due to agglomeration of fine alumina particle were found on the photosensitive member surface, these did not cause problems in practice.

Example 7

Tests were performed as in Example 1, but using Fine Alumina Particle 7. A change of toner charging and thus a change in image density were relatively small after 10,000 copying operations. Slight fogging occurred with slight toner scattering. Reproducibility of highlights was slightly decreased. Although defects due to agglomeration of fine alumina particle were found on the photosensitive member surface, these did not cause problems in practice.

Example 8

Tests were performed as in Example 1, but using Fine Alumina Particle 8. A change of toner charging and thus a change in image density were relatively small after 10,000 copying operations. Thus, fogging occurred with slight toner scattering. These phenomena, however, were not problems of practical significance. Deposits and defects were not found on the photosensitive member surface.

Example 9

Tests were performed as in Example 1, but using Fine Alumina Particle 9. The results were inferior to those of Example 1. That is, the amount of toner charging was decreased after 10,000 copying operations. Thus, the image density was increased, and fogging occurred with slight toner scattering.

Such a decrease in toner charging, particularly in high-temperature, high-humidity environments is probably due to a large amount of zinc compound, which is readily affected by moisture, contained in Fine Alumina Particle 9.

Example 10

Tests were performed as in Example 1, but using Fine Alumina Particle 10. The results were inferior to those of Example 1. That is, the amount of toner charging was increased after 10,000 copying operations. Thus, the image density due to a broad charging distribution was decreased, and slight fogging occurred with slight toner scattering. Defects were found on the photosensitive member surface.

Since Fine Alumina Particle 10 having a low BET specific surface area contained large amounts of agglomerates, the toner did not have high flowability, and the agglomerates probably damaged the photosensitive member surface.

Example 11

Tests were performed as in Example 1, but using Fine Alumina Particle 11. The results were inferior to those of Example 1. That is, an increase in image density, fogging, and slight toner scattering occurred after 10,000 copying operations. These phenomena are probably due to a high BET specific surface area of the fine alumina particle which causes a decrease in charging by moisture.

Example 12

Tests were performed as in Example 1, but using Fine Alumina Particle 12. A change in toner discharging after 10,000 copying operations was small. High-definition images having high image density and sufficient highlight reproducibility were obtained without fogging or toner scattering. Deposits and defects were not found on the photosensitive member surface.

Example 13

Tests were performed as in Example 1, but using a negatively chargeable cyan toner particle having a weight average particle diameter of 2.5 $\mu$m. The image density was slightly decreased in all the environments, and fogging occurred with slight toner scattering. These phenomena, however, were not problems of practical significance.

Since the toner has a smaller particle diameter, an increase in charges per unit weight probably causes such a decrease in image density. Furthermore, it is presumed that insufficient contact charging with the carrier forms insufficiently charged toner particles causing fogging and scattering.

Example 14

Tests were performed as in Example 1, but using a negatively chargeable cyan toner particle having a weight average particle diameter of 9.5 $\mu$m. A high image density was achieved in all the environments, but the image slightly lacked clarity, with a slightly lower level of fine line reproducibility. These phenomena, however, were not problems of practical significance.

The toner having a large particle diameter probably caused a low content of smaller particles of 4 $\mu$m or less, since such smaller particles contributed to reproducibility of fine lines.

Comparative Example 1

Tests were performed as in EXAMPLE 1, but using Fine Alumina Particle 13. Uniformity of toner charging was significantly decreased after 10,000 copying operations, and the image density was significantly decreased, with fogging and toner scattering, due to a broad toner charging distribution including highly charged toner particles to slightly charged toner particles.

Many defects due to agglomerates of the fine alumina particle and toner deposit were observed on the photosensitive member surface.

Accordingly, many agglomerates contained in Fine Alumina Particle 13 causes significant broadening of the particle diameter distribution, decrease in uniformity of toner charging, and the above problems.

Comparative Example 2

Tests were performed as in EXAMPLE 1, but using Fine Alumina Particle 14. Uniformity of toner charging was significantly decreased after 10,000 copying operations, and the image density was significantly decreased, with fogging and toner scattering, due to a broad toner charging distribution including highly charged toner particles to slightly charged toner particles.

Many defects due to agglomerates of the fine alumina particle and toner deposit were observed on the photosensitive member surface.

Accordingly, many agglomerates contained in Fine Alumina Particle 14 causes significant broadening of the particle diameter distribution, decrease in uniformity of toner charging, and the above problems.

Comparative Example 3

Tests were performed as in EXAMPLE 1, but using Fine Alumina Particle 15. After 10,000 copying operations, the image density was increased, with fogging and toner scattering. Since the fine alumina particle has a large BET specific surface area, a decrease in charge caused by moisture probably results in the above problems.

Many defects due to agglomerates of the fine alumina particle and toner deposit were observed on the entire surface of the photosensitive member. This suggests that the fine alumina particle has low abrasive characteristics to the toner, and significantly large agglomerates of the fine alumina particle are present.

Comparative Example 4

Tests were performed as in EXAMPLE 1, but using Fine Alumina Particle 16. After 10,000 copying operations, the image density was increased, with fogging and toner scattering. The results suggest that nonuniform surface treatment of the fine alumina particle causes nonuniform charge.

Many defects due to agglomerates of the fine alumina particle and toner deposit were observed on the surface of the photosensitive member.

The following are standards for evaluation of copying tests in EXAMPLES 1 to 14 and COMPARATIVE EXAMPLES 1 to 4.

(1) Image Density

The image density was measured using a Macbeth reflective densitometer.

(2) Fogging

The ten-thousandth copy was evaluated based on the following standards:

A: Fogging did not occur.

B: Slight fogging occurred.

C: Some extents of fogging occurred.

D: Significant fogging occurred.

(3) Toner Scattering

The ten-thousandth copy was evaluated by visual observation based on the following standards:

A: Toner did not scatter.

B: Toner scattered slightly.

C: Toner scattered moderately.

D: Toner scattered considerably.

(4) Highlight Reproducibility

A copy from an original having an image density of 0.5 was visually observed, and the highlight reproducibility was evaluated based on the following standards:

A: The copied image had a uniform image density and high fine line reproducibility.

B: The copied image slightly lacked uniformity of the image density.

C: The copied image had irregularities in the image density and fine lines having different thickness.

D: The copied image had significant irregularity of the image density and fine lines having significantly different thickness.

(5) Surface of Photosensitive Member

The ten-thousandth copy was evaluated by visual observation based on the following standards:

A: The surface of the photosensitive member did not have deposits and defects.

B: The surface of the photosensitive member had slight deposits.

C: The surface of the photosensitive member had slight deposits and defects.

D: The surface of the photosensitive member had a large amount of deposits and serious defects.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 3

| Fine alumina particle | Zirconium Content (μg/g) | Zinc Content (μg/g) | BET Specific Surface Area ($m^2/g$) | (A) Average Particle diameter (nm) | Methanol Hydrophobicity (%) | (B) 75% cumulative particle diameter (nm) | (B) − (A) |
|---|---|---|---|---|---|---|---|
| 1 | 450 | 151 | 172 | 10 | 63 | 22 | 12 |
| 2 | 365 | 0 | 163 | 12 | 55 | 25 | 13 |
| 3 | 433 | 134 | 150 | 11 | 65 | 16 | 5 |
| 4 | 550 | 0 | 155 | 13 | 56 | 20 | 7 |
| 5 | 200 | 10 | 109 | 12 | 64 | 23 | 11 |
| 6 | 700 | 300 | 193 | 13 | 57 | 25 | 12 |
| 7 | 421 | 118 | 101 | 81 | 67 | 116 | 35 |
| 8 | 387 | 106 | 270 | 14 | 30 | 29 | 15 |
| 9 | 422 | 431 | 163 | 14 | 50 | 21 | 7 |
| 10 | 480 | 160 | 118 | 110 | 83 | 121 | 11 |
| 11 | 350 | 107 | 399 | 5 | 45 | 21 | 16 |
| 12 | 489 | 131 | 166 | 17 | 69 | 32 | 15 |
| 13 | 0 | 0 | 160 | 11 | 61 | 26 | 15 |
| 14 | 149 | 6 | 105 | 12 | 58 | 30 | 18 |
| 15 | 754 | 346 | 450 | 17 | 43 | 31 | 14 |
| 16 | 0 | 0 | 72 | 21 | 46 | 43 | 22 |

TABLE 4

| | | | | High-temp., high-humidity environment | | | | |
|---|---|---|---|---|---|---|---|---|
| | Particle No. | Agglomeration factor of toner | Overhead projector tranparency of toner | Image density | Fogging | Toner scattering | Reproducibility | Surface state of photo-sensitive member |
| Ex. 1 | 1 | 8 | A | 1.80* | A | A | A | A |
| Ex. 2 | 2 | 12 | A | 1.78* | A | A | A | A |
| Ex. 3 | 3 | 18 | A | 1.68→1.57 | B | B | B | B |
| Ex. 4 | 4 | 19 | A | 1.67→1.55 | B | B | B | B |
| Ex. 5 | 5 | 30 | B | 1.66→1.53 | B | B | B | B |
| Ex. 6 | 6 | 23 | B | 1.65→1.50 | B | B | B | B |
| Ex. 7 | 7 | 36 | B | 1.63→1.50 | A | A | B | B |
| Ex. 8 | 8 | 15 | A | 1.71→1.86 | B | B | B | A |
| Ex. 9 | 9 | 19 | B | 1.71→1.86 | B | B | B | A |

TABLE 4-continued

| | | | | | | | | |
|---|---|---|---|---|---|---|---|---|
| Ex. 10 | 10 | 38 | C | 1.62→1.46 | C | C | C | C |
| Ex. 11 | 11 | 12 | A | 1.67→1.91 | C | C | B | B |
| Ex. 12 | 12 | 6 | A | 1.85* | A | A | A | A |
| Ex. 13 | 1 | 40 | A | 1.51→1.40 | B | B | B | B |
| Ex. 14 | 1 | 6 | A | 1.92* | A | A | B | A |
| Comp. Ex. 1 | 13 | 53 | D | 1.63→1.37 | D | D | D | D |
| Comp. Ex. 2 | 14 | 47 | C | 1.64→1.42 | C | C | C | D |
| Comp. Ex. 3 | 15 | 45 | C | 1.66→1.94 | D | D | D | D |
| Comp. Ex. 4 | 16 | 63 | C | 1.68→2.11 | D | D | D | D |

| | | Ambient-temp., low-humidity environment | | | | |
|---|---|---|---|---|---|---|
| | Particle No. | Image density | Fogging | Toner scattering | Reproducibility | Surface state of photo-sensitive member |
| Ex. 1 | 1 | 1.71* | A | A | A | A |
| Ex. 2 | 2 | 1.68* | A | A | A | A |
| Ex. 3 | 3 | 1.65→1.53 | A | A | B | B |
| Ex. 4 | 4 | 1.64→1.51 | A | A | B | B |
| Ex. 5 | 5 | 1.60→1.43 | B | B | B | B |
| Ex. 6 | 6 | 1.59→1.41 | B | B | B | B |
| Ex. 7 | 7 | 1.58→1.39 | A | A | B | B |
| Ex. 8 | 8 | 1.60→1.71 | A | A | A | A |
| Ex. 9 | 9 | 1.63→1.74 | B | B | B | A |
| Ex. 10 | 10 | 1.42→1.10 | C | C | C | C |
| Ex. 11 | 11 | 1.58→1.80 | C | C | C | B |
| Ex. 12 | 12 | 1.77* | A | A | A | A |
| Ex. 13 | 1 | 1.42→1.31 | B | B | B | B |
| Ex. 14 | 1 | 1.72* | A | A | B | A |
| Comp. Ex. 1 | 13 | 1.48→1.08 | D | D | D | D |
| Comp. Ex. 2 | 14 | 1.47→1.19 | C | C | C | D |
| Comp. Ex. 3 | 15 | 1.60→1.85 | D | D | D | D |
| Comp. Ex. 4 | 16 | 1.71→2.21 | D | D | D | D |

Ex.: Example
Comp. Ex.: Comparative Example
*: Stable change

What is claimed is:

1. A toner comprising toner particles and fine alumina particles;

wherein the toner particles include a binding resin and a colorant, and the fine alumina particles contain 200 to 700 $\mu$g of zirconium compound per gram of alumina.

2. A toner according to claim 1, wherein the fine alumina particles contain 10 to 300 $\mu$g of a zinc compound per gram of alumina.

3. A toner according to claim 1, wherein the fine alumina particles have a BET specific surface area in a range of 100 to 350 $m^2/g$.

4. A toner according to claim 1, wherein the fine alumina particles have a BET specific surface area in a range of 150 to 300 $m^2/g$.

5. A toner according to claim 1, wherein the fine alumina particles are subjected to hydrophobic treatment.

6. A toner according to claim 1, wherein the fine alumina particles are subjected to hydrophobic treatment, and has a hydrophobicity of 40 to 90%.

7. A toner according to claim 1, wherein the fine alumina particles are subjected to hydrophobic treatment with a silane coupling agent.

8. A toner according to claim 1, wherein the fine alumina particles have a number average particle diameter in a range of 1 to 100 nm.

9. A toner according to claim 1, wherein the binding resin is a polyester resin.

10. A toner according to claim 1, wherein the toner particles have a weight average particle diameter in a range of 3 to 9 $\mu$m.

* * * * *

UNITED STATES PATENT AND TRADEMARK OFFICE

CERTIFICATE OF CORRECTION

PATENT NO. : 5,994,018
DATED : November 30, 1999
INVENTOR(S) : Wakashi Iida et al.

It is certified that error appears in the above-identified patent and that said Letters Patent is hereby corrected as shown below:

Title page,
Item [75], Inventors: "[76] Inventors: Wakashi Iida; Masaaki Taya; Makoto Kanbayashi; Tesuya Ida; Junko Inaba, all c/o Canon Kabushiki Kaisha 3-30-2, Shimomaruko, Ohta-ku, Tokyo, Japan" should read -- [75] Inventors: Wakashi Iida, Numazu; Masaaki Taya, Mishima; Makoto Kanbayashi, Shizuoka; Tesuya Ida, Junko Inaba, both of Mishima, all of Japan --; and
Item [73], Assignee: insert -- [73] Assignee: Canon Kabushiki Kaisha, Tokyo, Japan --.

Column 2,
Line 39, "in, images" should read -- in images, --.

Column 3,
Line 23, "fine" should read -- a fine --; and
Line 58, "are" should read -- is --.

Column 7,
Line 33, "(a)" should read -- (α) --.

Column 8,
Line 57, "and an" should read -- and a --.

Column 9,
Line 61, "sections;" should read -- sections, --.

Column 10,
Line 50, "1,3-butanediol," (second occurrence) should be deleted;
Line 52, "2-ethyl-1, 3-hexane diol," should read -- 2-ethyl-1, 3-hexanediol, --; and
Line 65, "a" should read -- an --.

Column 12,
Line 36, "to" should read -- to 30 --.

Column 14,
Line 4, "diameter" should read -- Diameter --; and
Line 25, "diameter" should read -- Diameter --.

UNITED STATES PATENT AND TRADEMARK OFFICE

CERTIFICATE OF CORRECTION

PATENT NO. : 5,994,018
DATED : November 30, 1999
INVENTOR(S) : Wakashi Iida et al.

It is certified that error appears in the above-identified patent and that said Letters Patent is hereby corrected as shown below:

Column 15,
Line 4, "Agglomerationfactor (%)" should read -- Agglomeration factor (%) --;
Line 24, "EXAMPLES" should read -- examples --;
Line 42, "Zr(OH)" should read -- $Zr(OH)_4.xH_2O$ --; and
Line 43, "$_4.xH_2O$ " should be deleted.

Column 16,
Line 1, "filtered," should read -- filtered --.

Column 17,
Line 49, "by 10,000 times" should read -- 10,000 times by --.

Column 20,
Line 19, "causes" should read -- caused --; and
Line 36, "causes" should read -- caused --.

Signed and Sealed this

Twenty-eighth Day of January, 2003

JAMES E. ROGAN
*Director of the United States Patent and Trademark Office*